US007758325B2

(12) United States Patent
Kabir et al.

(10) Patent No.: US 7,758,325 B2
(45) Date of Patent: Jul. 20, 2010

(54) COMPRESSOR SYSTEM AND FRAME

(75) Inventors: Omar M. Kabir, Waller, TX (US); Zahroof Mohamed, Cypress, TX (US); Aaron R. Merritt, Hockley, TX (US); Kent Pearl, Katy, TX (US)

(73) Assignee: Cameron International Corporation, Houston, TX (US)

( * ) Notice: Subject to any disclaimer, the term of this patent is extended or adjusted under 35 U.S.C. 154(b) by 551 days.

(21) Appl. No.: 11/545,992

(22) Filed: Oct. 10, 2006

(65) Prior Publication Data

US 2008/0085201 A1 Apr. 10, 2008

(51) Int. Cl.
*F04B 23/06* (2006.01)

(52) U.S. Cl. ..... 417/521

(58) Field of Classification Search ..... 417/534; 92/139, 261

See application file for complete search history.

(56) References Cited

U.S. PATENT DOCUMENTS 2,539,132 A 1/1951 Harper
2,956,738 A * 10/1960 Rosenschold et al. ..... 417/534
3,045,898 A 7/1962 Hilfing et al.
3,302,537 A * 2/1967 Blaudszun et al. ..... 92/261
4,756,674 A 7/1988 Miller
4,762,051 A * 8/1988 Besic et al. ..... 92/165 R
5,507,219 A * 4/1996 Stogner ..... 92/128
6,959,756 B2 11/2005 Woodard et al.
7,063,004 B1 6/2006 Kabir
7,073,775 B2 7/2006 Kabir et al.
2002/0012592 A1 1/2002 Nishikawa et al.
2002/0063368 A1 5/2002 Kabir
2003/0048964 A1 3/2003 Brackett et al.
2006/0180018 A1 8/2006 Kabir et al.

OTHER PUBLICATIONS

Cooper Compression Division, "True innovation. Proven technology. One powerfully reliable compressor." Cooper Cameron Corporation Apr. 2005, available at http://www.c-a-m.com/cam/search/showdocw.cfm?Document_ID=8669.

* cited by examiner

*Primary Examiner*—Devon C Kramer
*Assistant Examiner*—Bryan Lettman
(74) *Attorney, Agent, or Firm*—Fletcher Yoder P.C.

(57) ABSTRACT

A reciprocating compressor is provided. In one embodiment, the reciprocating compressor includes a frame having a central body and a crosshead guide extending from the central body. The compressor may also include a crosshead disposed within the crosshead guide and coupled to a crankshaft disposed within the central body of the frame. Additionally, the compressor may include at least one support structure extending from the crosshead guide to the central body, comprising an oblique support structure formed at an angle with respect to the horizontal and vertical dimensions of the crosshead. Other embodiments of compression systems, devices, and frames of such systems are also provided.

19 Claims, 5 Drawing Sheets

COMPRESSOR SYSTEM AND FRAME

FIELD OF THE INVENTION

The present invention relates generally to compression systems. More particularly, the present invention relates to a novel compressor frame for such systems.

BACKGROUND

This section is intended to introduce the reader to various aspects of art that may be related to various aspects of the present invention, which are described and/or claimed below. This discussion is believed to be helpful in providing the reader with background information to facilitate a better understanding of the various aspects of the present invention. Accordingly, it should be understood that these statements are to be read in this light, and not as admissions of prior art.

As will be appreciated, natural gas has a wide array of uses in industrial and commercial applications. For instance, natural gas may be used to provide power to a range of vehicles, to heat homes during winter, and to operate various consumer appliances, such as ovens or clothes dryers. Further, natural gas may be used to generate electricity for distribution over a power grid, and may be used in the manufacture of an array of products and materials, including glass, steel, and plastics, for example.

In order to meet the demand for natural gas, companies may spend a significant amount of time and resources searching for, extracting, and transporting natural gas. It will be appreciated that natural gas may be produced from oil fields, in which case the gas may be referred to as casinghead gas, or from natural gas fields. As may also be appreciated, transportation of such natural gas, such as through a pipeline from the production site to a consumer, is often facilitated by compression of the gas via a compressor.

One common type of compressor for such applications is the reciprocating compressor. Such reciprocating compressors are positive-displacement devices that generally utilize a crankshaft that is coupled to pistons, via connecting rods and crossheads, to reciprocally drive the pistons and compress a fluid within an attached cylinder. Reciprocating compressors typically include a frame that houses various internal components, such as the crankshaft. In one common type of reciprocating compressor, crosshead guides are coupled between compression cylinders and the frame, and may cooperate with the crankshaft to induce linear motion of the crossheads.

Operation of the reciprocating compressor results in a number of forces that are exerted on the compressor frame and the crosshead guides, including torque, coupled moments, unbalanced forces, and reciprocating loads. In order to compensate for such forces, the frames, the crosshead guides, and bolts for connecting the crosshead guides to a frame are often designed with additional size and weight. As will be appreciated, such designs result in higher manufacturing costs and increased installation difficulty.

There is a need, therefore, for a reciprocating compressor exhibiting increased stiffness of the frame and crosshead supports, while reducing the size and manufacturing costs associated with such a compressor.

SUMMARY

Certain aspects commensurate in scope with the originally claimed invention are set forth below. It should be understood that these aspects are presented merely to provide the reader with a brief summary of certain forms the invention might take and that these aspects are not intended to limit the scope of the invention. Indeed, the invention may encompass a variety of aspects that may not be set forth below.

Embodiments of the present invention generally relate to a novel reciprocating compressor frame. In certain embodiments, an exemplary compressor frame includes one or more crosshead guides extending from a central body. The crosshead guides may be formed integrally with the central body, or may be discrete components that are coupled to the central body. Further, in at least one embodiment, the central body is substantially cylindrical or barrel-shaped. Additionally, the exemplary compressor frame of one embodiment includes one or more angled or oblique support structures extending between a crosshead guide and the central body. The angled support structures enhance the stiffness of the crosshead guide from which they extend in both horizontal and vertical directions. Further, the angle at which these support structures are oriented may be varied in different embodiments, to adjust the relative stiffness of the crosshead guide in one dimension, i.e., the horizontal or vertical, with respect to the other.

Various refinements of the features noted above may exist in relation to various aspects of the present invention. Further features may also be incorporated in these various aspects as well. These refinements and additional features may exist individually or in any combination. For instance, various features discussed below in relation to one or more of the illustrated embodiments may be incorporated into any of the above-described aspects of the present invention alone or in any combination. Again, the brief summary presented above is intended only to familiarize the reader with certain aspects and contexts of the present invention without limitation to the claimed subject matter.

BRIEF DESCRIPTION OF THE DRAWINGS

These and other features, aspects, and advantages of the present invention will become better understood when the following detailed description is read with reference to the accompanying drawings in which like characters represent like parts throughout the drawings, wherein.

DETAILED DESCRIPTION OF SPECIFIC EMBODIMENTS

One or more specific embodiments of the present invention will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present invention, the articles "a," "an," "the," and "said" are intended to mean that there are one or more of the elements. The terms "comprising," "including," and "having" are intended to be inclusive and mean that there may be additional elements other than the listed elements. Moreover, the use of "top," "bottom," "above," "below," and variations of these terms is made for convenience, but does not require any particular orientation of the components.

Figure 1:
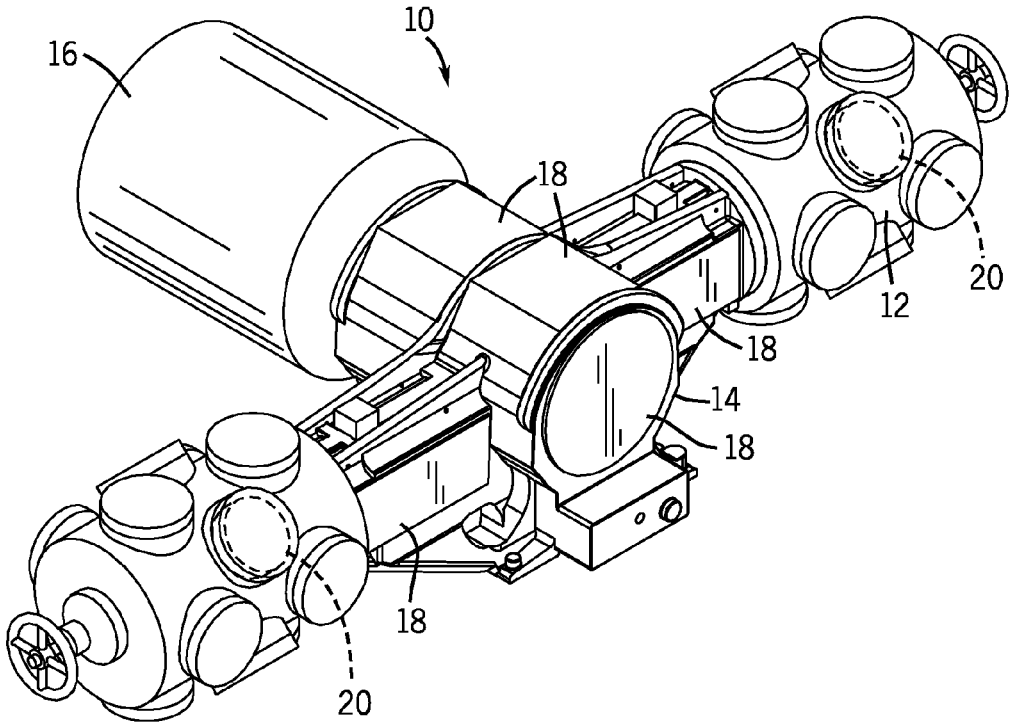
FIG. 1 is a perspective view of a reciprocating compressor including an exemplary frame constructed in accordance with one embodiment of the present invention.

Turning now to the figures, an exemplary compressor 10 is provided in FIG. 1. In the presently illustrated embodiment, the compressor 10 includes a pair of compression cylinders 12 coupled to a frame 14. As discussed in greater detail below, a variety of internal components may be disposed within the cylinders 12 and the frame 14 to enable compression of fluids introduced into the compressor 10 the cylinders 12. In one embodiment, the compressor 10 may be utilized to compress natural gas. However, in other embodiments, the compressor 10 may be configured and/or utilized to compress other fluids.

A mechanical power source or driver 16, such as an engine or an electric motor, may be coupled to the compressor 10 to provide mechanical power to the various internal components and enable compression of the fluid within the cylinders 12. To facilitate access to such internal components, as may be desired for diagnostic or maintenance purposes, openings in the frame 14 may be provided and selectively accessed via removable covers 18. Further, the cylinders 12 may also include valve assemblies 20 for controlling flow of the fluid through the cylinders 12.

It will be appreciated that, although the exemplary compressor 10 is illustrated as a two-throw reciprocating compressor, other compressor configurations may also employ and benefit from the presently disclosed techniques. For instance, in other embodiments, the compressor 10 may include a different number of cylinder throws, such as a four-throw compressor, a six-throw compressor, a couple-free reciprocating compressor, a screw compressor, or the like. Further, other variations are also envisaged, including variations in the length of stroke, the operating speed, and the size, to name but a few.

Figure 2:
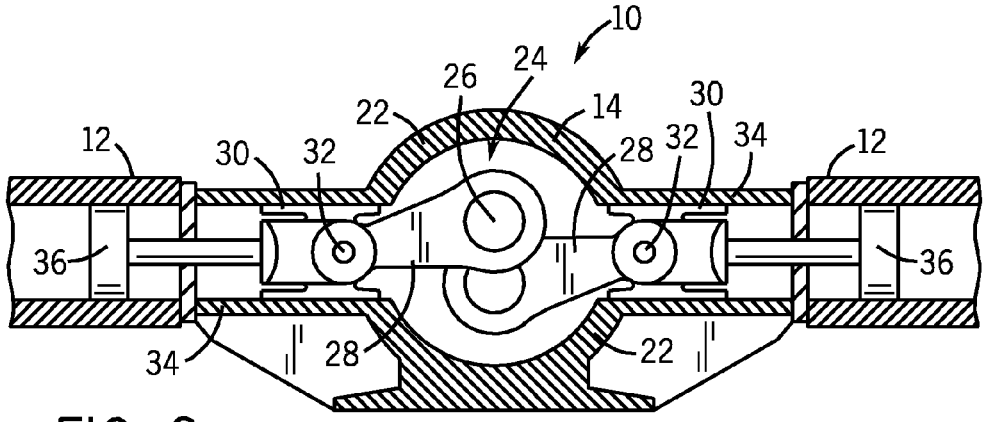
FIG. 2 is an axial cross-sectional view of the exemplary compressor of FIG. 1, illustrating internal components of the compressor in accordance with one embodiment of the present invention.

A cross-sectional view of the exemplary compressor 10 is provided in FIG. 2, which illustrates a number of exemplary internal components of the compressor of FIG. 1. In the presently illustrated embodiment, the frame 14 of the exemplary compressor 10 includes a hollow central body or housing 22 that generally defines an interior volume 24 in which various internal components may be received, such as a crankshaft 26. In one embodiment, the central body 22 may have a generally curved or cylindrical shape. It should be noted, however, that the central body 22 may have other shapes or configurations in full accordance with the present techniques.

In operation, the driver 16 rotates the crankshaft 26 supported within the interior volume 24 of the frame 14. In one embodiment, the crankshaft 26 is coupled to crossheads 30 via connecting rods 28 and pins 32. The crossheads 30 are disposed within crosshead guides 34, which generally extend from the central body 22 and facilitate connection of the cylinders 12 to the compressor 10. In one embodiment, the compressor 10 includes two crosshead guides 34 that extend generally perpendicularly from opposite sides of the central body or housing 22, although other configurations are also envisaged. As may be appreciated, the rotational motion of the crankshaft 26 is translated via the connecting rods 28 to reciprocal linear motion of the crossheads 30 within the crosshead guides 34.

As noted above, the cylinders 12 are configured to receive a fluid for compression. The crossheads 32 are coupled to pistons 36 disposed within the cylinders 12, and the reciprocating motion of the crossheads allows compression of fluid within the cylinders 12 via the pistons 36. Particularly, as a piston 36 is driven forward (i.e., outwardly from central body 22) into a cylinder 12, the piston 36 forces the fluid within the cylinder into a smaller volume, thereby increasing the pressure of the fluid. A discharge valve of valve assembly 20 may then be opened to allow the pressurized or compressed fluid to exit the cylinder 12. The piston 36 may then stroke backward, and additional fluid may enter the cylinder 12 through an inlet valve of the valve assembly 20 for compression in the same manner described above.

As may be appreciated, the compressor 10 will be subjected to various forces during operation, such as reciprocating loads, torque, coupled moments, and the like. While partially balancing operation of the compressor, such as staggering the timing of forward strokes within the crosshead guides, may reduce or compensate for some of these operating forces and unbalanced loads, some of these forces and loads may still act on the frame 14. More specifically, these operating forces and the orientation of the various components may result in three-dimensional forces and moments (e.g., horizontal, vertical, and axial) that act on the crosshead guides 34 and on the central body 22 of the frame 14. Accordingly, as illustrated in FIGS. 3-6, the exemplary frame 14 includes various features for distributing such forces and moments without excessive distortion, in addition to other features that facilitate installation and maintenance of the compressor 10.

Figure 3:
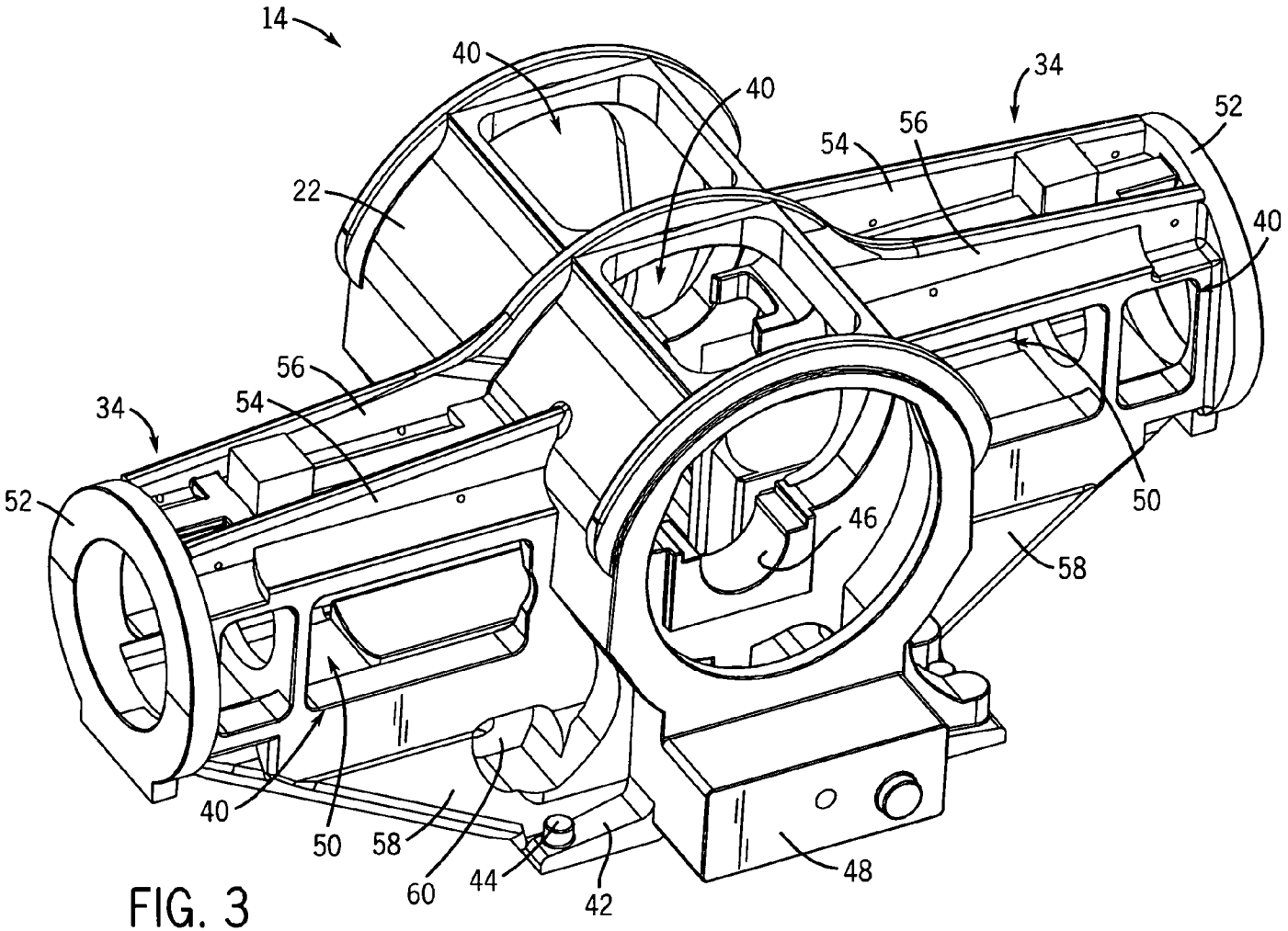
FIG. 3 is a perspective view of the exemplary compressor frame of FIG. 1, illustrating various structural features of the frame in accordance with one embodiment of the present invention.

Particularly, a perspective view of the exemplary frame 14 is provided in FIG. 3. The frame 14 may include a number of features that facilitate mounting and operation of the compressor 10. For instance, the exemplary frame 14 includes a plurality of openings 40 that facilitate access to internal components of the compressor 10. As noted above, such access may allow for easier maintenance, reducing both the time and expense associated with maintaining the compressor 10 and its associated components. Further, the compressor 10 may also include a base 42 that enables the compressor 10 to be secured to a supporting structure, such as a foundation. In one embodiment, the base 42 may be configured to receive locking members, such as bolts 44, for securing the frame 14 to its support. Still further, the interior of the frame 14 may include a variety of surfaces or structural members 46, such as bearing supports, heat dissipation features, structural reinforcements, or the like. Additionally, the frame 14 may also include other features, such as a housing 48 for receiving a lubrication assembly for lubricating various moving components of the compressor 10, for instance.

The crosshead guides 34 extending from the central body 22 generally include an interior volume or cavity 50 for receiving the crossheads 30 (FIG. 2), and an end portion 52 for coupling to the cylinders 12 (FIG. 1). It bears noting that, while the illustrated embodiment includes a frame 14 having only two crosshead guides 34, other embodiments may include a different number of crosshead guides. For instance, in some embodiments, the frame 14 may include one or more additional pairs of crosshead guides, such as a total of four crosshead guides for a four-throw compressor, or a total of six crosshead guides for a six-throw compressor. Indeed, any number of crosshead guides may be included in full accordance with the present techniques.

As the compressor 10 is operated, the crosshead guides 34 are subject to various operating forces, including those noted above, which may be distributed to the frame 14 via a number of support structures. In one embodiment, such support structures include support members or ribs 54 and 56, and angled supports 58, as discussed in greater detail below. Notably, the angled supports 58 may include one or more apertures 60 that facilitate handling and installation of the compressor 10.

Figure 4:
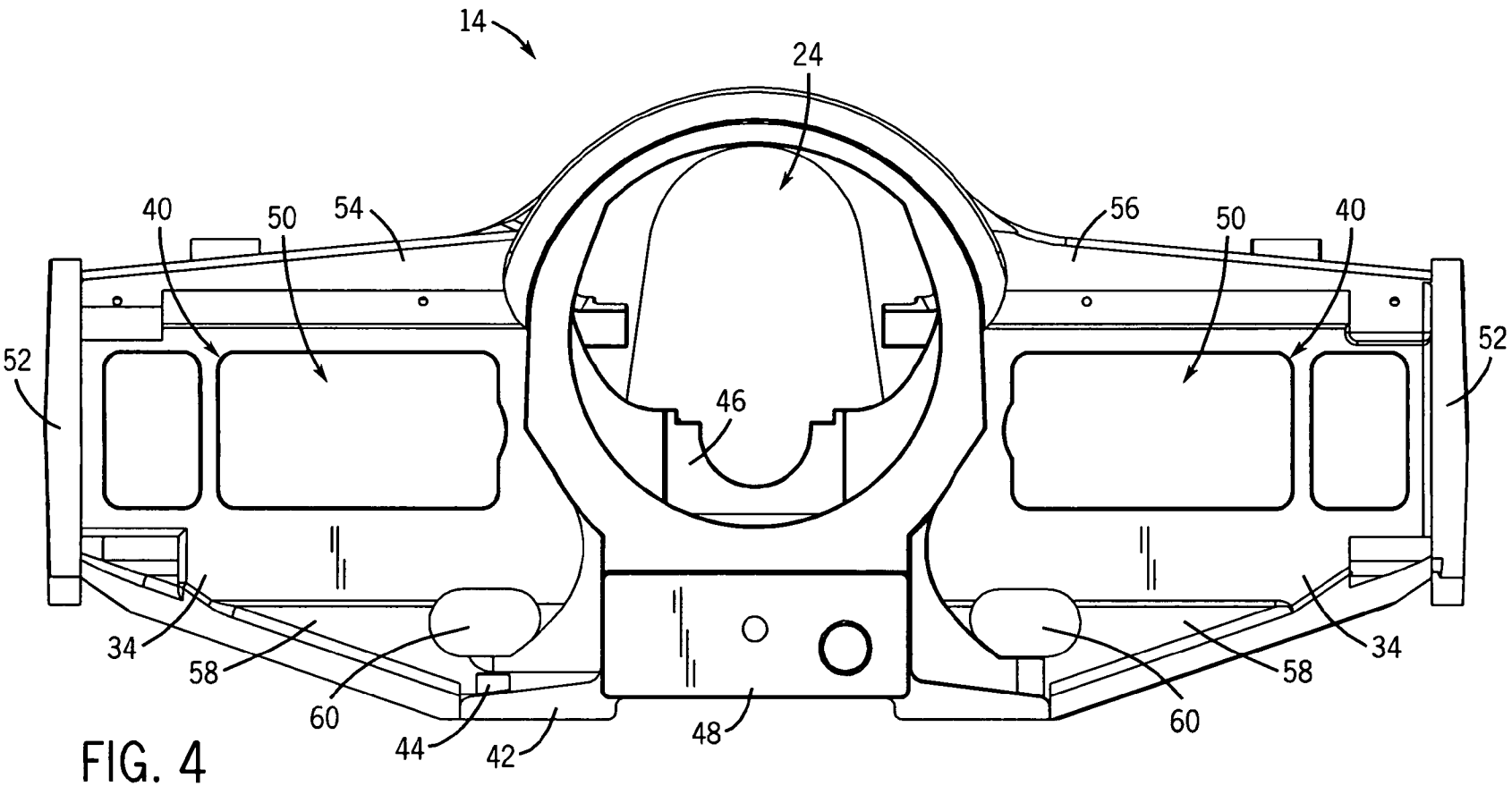
FIG. 4 is a front elevational view of the exemplary frame provided in FIG. 3.

Several of the above features, including the support structures, may also be seen in FIG. 4, which is a front elevational view of the compressor frame 14. It should also be noted that, in one embodiment, the central body 22, the crosshead guides 34, and one or more of the support structures 54, 56, and 58 are integral with one another, i.e., formed from a single piece of material. For instance, these various features may be machined or otherwise formed from a single casting. However, in other embodiments, one or more of these members may be formed separate from the others and may then be assembled, such as by welding.

Figure 5:
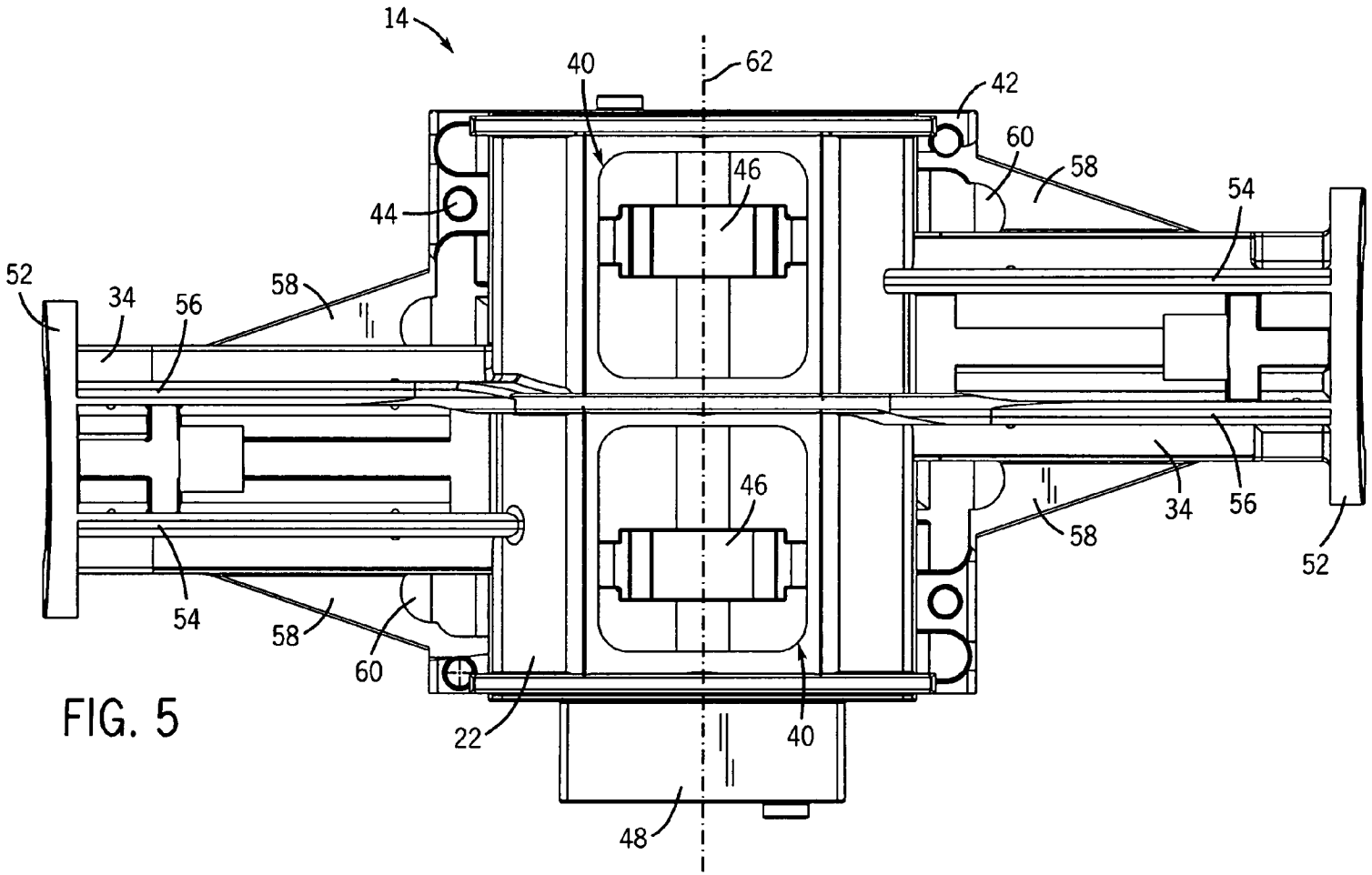
FIG. 5 is a top plan view of the frame of FIGS. 3 and 4, further illustrating the various structural features of the frame in accordance with one embodiment of the present invention.
Figure 6:
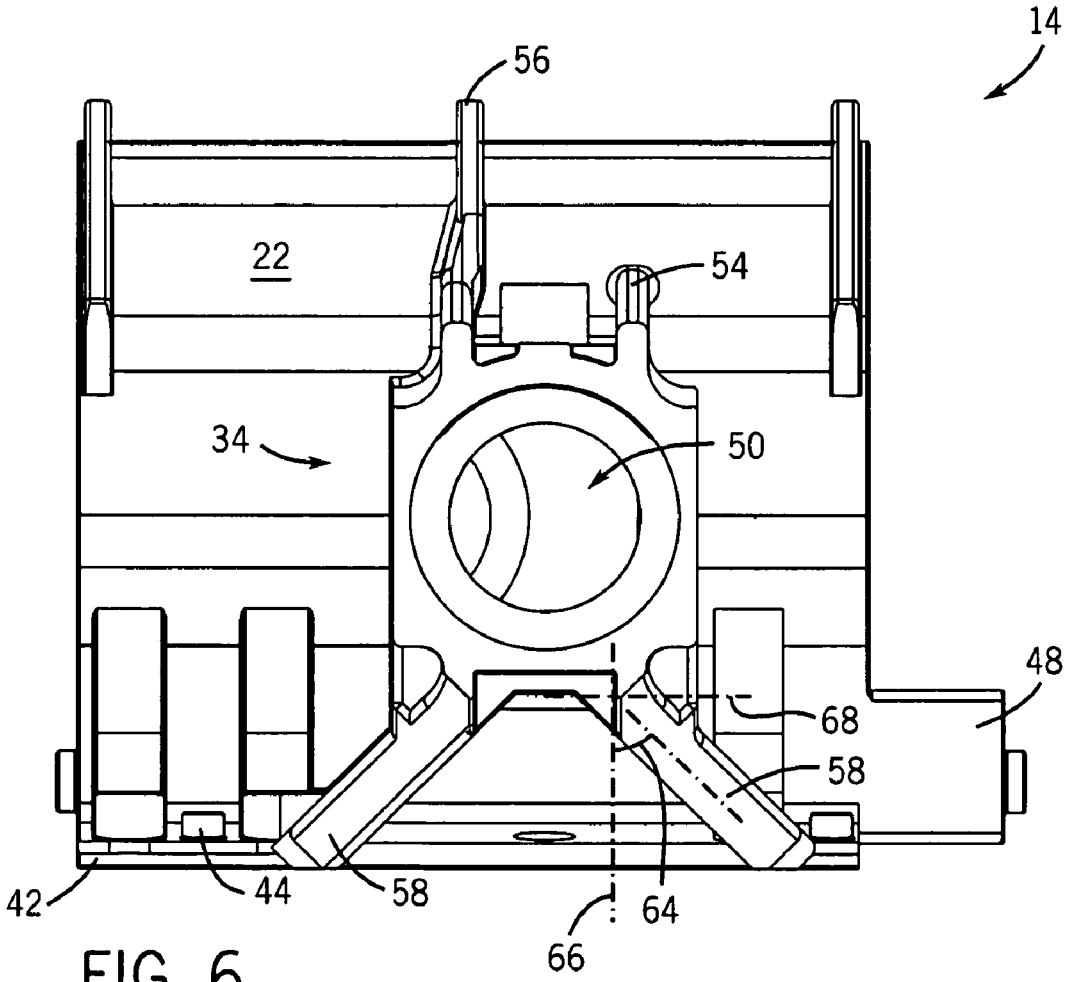
FIG. 6 is side elevational view of the exemplary frame depicted in FIGS. 3-5, illustrating the orientation of angled support structures with respect to crosshead guides of the frame in accordance with one embodiment of the present invention.

The configuration of the angled supports 58 may be better appreciated through reference to FIGS. 5 and 6. Particularly, FIG. 5 is a top plan view of the exemplary frame 14 illustrating the extension of exemplary angled supports 58 beyond the horizontal or lateral surfaces of the crosshead guides 34. In the present embodiment, the two crosshead guides 34 are axially offset from one another along an axis 62 of the central body 22. In this embodiment, each of the crosshead guides 34 includes an individual support rib 54 that extends from an end portion 52 to the central body 22. Additionally, in certain embodiments, each pair of crosshead guides share a common support rib 56 that extends from the end portion 52 of one of the crosshead guides 34, about the curved central body 22, and to the end portion 52 of the other crosshead guide 34.

As will be appreciated, the exemplary support ribs 54 and 56 increase the structural rigidity of the exemplary frame 14, and distribute forces exerted on the crosshead guides 34 to the central body 22. It should be noted that, while the exemplary ribs 54 and 56 are illustrated as formed vertically from the top surface of the crosshead guides 34, vertical or horizontal support ribs may be provided on the other surfaces of the crosshead guides 34 instead of, or in addition to, those formed on the top surface. Additionally, as noted above and discussed in greater detail below, angled supports 58 generally extend outwardly from crosshead guides 34 to the central body 22 of the frame 14.

In addition to the plan view of FIG. 5, the configuration and functionality of the angled supports 58 may be better understood with reference to FIG. 6, which is a side elevational view of the frame 14. For the sake of clarity, the end portion 52 has been omitted from the illustration of FIG. 6 to more clearly depict the orientation of the angled supports 58 with respect to the crosshead guides 34. In the presently illustrated embodiment, the angled supports 58 are angled with respect to the horizontal and vertical dimensions of the crosshead 34. More particularly, in one embodiment, each angled support 58 may considered to be oriented with respect to a vertical plane 66 parallel to the longitudinal axis of the crosshead guide 34, and perpendicular to the axis 62 of the central body 22, to form an angle 64. As will be appreciated, such orientation will form a complimentary angle between the support 58 and a horizontal plane 68 that is also parallel to the longitudinal axis of the crosshead guide 34 and perpendicular to the vertical plane 66. This radial deviation of the angled support 58, defined by the angle 64, provides increased stiffness and force distribution in both horizontal and vertical directions or dimensions parallel to, or within, the planes 66 and 68.

It should be noted that the relative stiffness provided by an angled support 58 in each of the horizontal and vertical dimensions will depend upon the angle 64. For instance, in one embodiment, an angled supports 58 is oriented such that angle 64 is substantially equal to forty-five degrees with respect to the vertical plane 66. In this embodiment, the angled supports 58 provide increased stiffness of equal amount in both the vertical and horizontal planes 66 and 68. Other embodiments, however, are also envisaged.

For instance, in one embodiment, the angled supports 58 may be oriented at a smaller angle 64, such as between ten and forty-five degrees, or a larger angle 64, such as between forty-five and eighty degrees, with respect to a vertical plane, such as the vertical plane 66. In such embodiments, the stiffness provided by the angled supports 58 would vary between the horizontal and vertical planes. Particularly, when the angle 64 is less than forty-five degrees greater stiffness would be provided in the vertical direction than the horizontal direction, whereas the converse is true if the angle 64 is greater than forty-five degrees. In still further embodiments, the angled supports 58 may be oriented with angles that are similar or dissimilar than one another. Indeed, in full accordance with the present techniques, the angled supports 58 may form any non-zero angle with respect to a horizontal or vertical plane or dimension, such as planes 66 and 68, through the crosshead guides 34 such that the angled supports 58 are oblique or non-orthogonal with respect to such planes or dimensions. Additionally, the angled supports 58 distribute such forces and moments over a wider portion of the central body 22 of the frame 14, reducing the magnitude of the coupled moment of the frame 14 attributable to the axial displacement of the crosshead guides 34.

While the invention may be susceptible to various modifications and alternative forms, specific embodiments have been shown by way of example in the drawings and have been described in detail herein. However, it should be understood that the invention is not intended to be limited to the particular forms disclosed. Rather, the invention is to cover all modifications, equivalents, and alternatives falling within the spirit and scope of the invention as defined by the following appended claims.

The invention claimed is:

1. A reciprocating compressor comprising:

a frame including:

a hollow central body defining an interior volume and including a base;

first and second crosshead guides extending from opposite sides of the central body, each of the first and second crosshead guides including a first end portion coupled to the central body and a second end portion configured to be coupled to a compression cylinder; and at least one support structure extending from the second end portion of each of the first and second crosshead guides to the first end portion and the central body, wherein the at least one support structure comprises an oblique support structure formed at an angle with respect to first and second dimensions of the respective crosshead guide, the first and second dimensions perpendicular to one another within a first plane that is perpendicular to a longitudinal axis of the respective crosshead guide, to increase stiffness of the respective crosshead guide in both the first and second dimensions, wherein the first dimension is parallel to a second plane defined by the base a crosshead disposed within each of the first and second crosshead guides a crankshaft disposed within the interior volume and coupled to each crosshead via a connecting rod, wherein the crankshaft and each crosshead are configured such that rotation of the crankshaft during operation induces linear motion of each crosshead within the respective crosshead guide wherein the first crosshead guide and its associated oblique support structure are opposed to and at least partially axially overlap the second crosshead guide and its associated oblique support structure along the hollow central body such that during operation the oblique support structures of the first and second crosshead guides reduce a coupled moment of the frame resulting from the induced linear motion of the crossheads within the respective first and second crosshead guides.

2. The reciprocating compressor of claim 1, wherein the central body comprises a generally cylindrical body.

3. The reciprocating compressor of claim 1, wherein each of the first and second crosshead guides and its respective at least one support structure are formed integrally with the central body.

4. The reciprocating compressor of claim 1, wherein the oblique support structure is formed at an angle substantially equal to forty-five degrees with respect to both the first and second dimensions of the respective crosshead guide to increase stiffness of the respective crosshead guide in substantially equal amounts in both the first and second dimensions.

5. The reciprocating compressor of claim 1, wherein the first and second crosshead guides are axially offset from one another along the central body.

6. The reciprocating compressor of claim 5, wherein the at least one support structure includes a longitudinal rib common to the first and second crosshead guides and the central body.

7. The reciprocating compressor of claim 5, wherein the at least one support structure comprises a support rib formed on a surface of the first or second crosshead guide and terminating at the central body.

8. The reciprocating compressor of claim 1, wherein the at least one support structure comprises a plurality of oblique support structures including at least a first pair of oblique support structures extending from the first crosshead guide and a second pair of oblique support structures extending from the second crosshead guide.

9. The reciprocating compressor of claim 8, wherein the two oblique support structures of the first pair of oblique support structures extend beyond opposite sides of the first crosshead guide.

10. The reciprocating compressor of claim 9, wherein each of the two oblique support structures of the first pair of oblique support structures are formed at a substantially identical angle with respect to the second dimension of the first crosshead guide.

11. The reciprocating compressor of claim 1, wherein the at least one support structure includes a support rib formed orthogonally with respect to one of the first or second dimensions of the respective crosshead guide.

12. A reciprocating compressor frame comprising:

a central body having a base, an inner surface and an outer surface, wherein the inner surface defines an interior volume and is configured to receive an internal compressor component;

a pair of crosshead guides extending from opposite sides of the central body, each of the crosshead guides including a frame end coupled to the central body and a cylinder end configured to attach to a compression cylinder, each of the crosshead guides also having a height and a width corresponding to first and second dimensions orthogonal to each other and to a longitudinal axis of the respective crosshead guide, the second dimension parallel to a surface of the base, wherein each of the crosshead guides is configured to receive a crosshead and to facilitate reciprocating linear motion of the respective crossheads; and a plurality of support structures extending from the cylinder ends of the pair of crosshead guides to the frame ends and the central body, wherein each of the support structures of the plurality of support structures is formed on one of the crosshead guides at a non-orthogonal angle with respect to a plane parallel to the longitudinal axis of the respective crosshead guide and orthogonal to the surface of the base to increase the rigidity of the crosshead guide in each of the first and second dimensions, and wherein one of the pair of crossheads guides and one or more support structures extending therefrom are opposed to and at least partially overlapping the other of the pair of crosshead guides and one or more support structures extending therefrom about the central body to reduce a coupled moment of the reciprocating compressor frame resulting from the reciprocating linear motion of the respective crossheads of the pair of crosshead guides.

13. The reciprocating compressor frame of claim 12, wherein the central body, the pair of crosshead guides, and the plurality of support structures are formed integrally with one another.

14. The reciprocating compressor frame of claim 12, wherein the central body comprises a generally cylindrical body.

15. The reciprocating compressor frame of claim 12, wherein at least one support structure of the plurality of support structures is formed on one of the crosshead guides at a non-orthogonal angle with respect to the plane parallel to the longitudinal axis of the respective crosshead guide substantially equal to forty-five degrees such that at least one support structure enhances the rigidity of the crosshead guide by a substantially equal magnitude in each of the first and second dimensions.

16. The reciprocating compressor frame of claim 12, wherein each of the support structures of the plurality of support structures is formed on one of the crosshead guides at substantially identical non-orthogonal angles with respect to the plane parallel to the longitudinal axis of the respective crosshead guide.

17. A reciprocating compressor system comprising:

a crankshaft;

a housing disposed about the crankshaft, the housing configured to facilitate rotation of the crankshaft during operation of the compressor system;

a driver coupled to the crankshaft and configured to drive rotation of the crankshaft during operation;

a plurality of crosshead guides comprising at least first and second crosshead guides extending from opposite sides of the housing, the first and second crosshead guides including housing end portions adjacent the housing;

a plurality of compression cylinders coupled to compression cylinder end portions of the plurality of crosshead guides opposite the housing end portions;

a plurality of crossheads disposed within the plurality of crosshead guides and coupled to the crankshaft such that rotation of the crankshaft during operation induces reciprocal linear motion of each crosshead within its respective crosshead guide, wherein each crosshead is coupled to a respective piston disposed within one of the compression cylinders and drives the respective piston to facilitate compression of a fluid within the compression cylinder; and a plurality of angled support structures extending from the compression cylinder end portions of the crosshead guides to the housing end portions and the housing, wherein each angled support structure of the plurality of angled support structures is oriented at non-zero angles with respect to a first plane perpendicular to a rotational axis of the crankshaft within the housing and parallel to a longitudinal axis of the respective crosshead guide from which each angled support structure extends, and with respect to a horizontal second plane perpendicular to the vertical first plane, and wherein the first crosshead guide includes at least one angled support structure of the plurality of angled support structures, the second crosshead guide includes at least one angled support structure and the first and second crosshead guides and their respective at least one angled support structures at least partially axially overlap with respect to the rotational axis of the crankshaft such that the plurality of angled support structures reduce a coupled moment of the housing disposed about the crankshaft resulting from the reciprocal linear motion of the plurality of crossheads within the plurality of crosshead guides.

18. The reciprocating compressor system of claim 17, wherein the housing is substantially cylindrical.

19. The reciprocating compressor system of claim 17, wherein the plurality of angled support structures, the plurality of crosshead guides, and the housing are formed integrally with one another.

* * * * *